United States Patent [19]

Klundt

[11] 4,152,995

[45] May 8, 1979

[54] SEWING MACHINE HAVING A DRIVEN FEED ROLLER

[75] Inventor: Kurt Klundt, Hirschhorn, Fed. Rep. of Germany

[73] Assignee: Pfaff Industriemaschinen GmbH, Fed. Rep. of Germany

[21] Appl. No.: 887,554

[22] Filed: Mar. 17, 1978

[30] Foreign Application Priority Data

Apr. 27, 1977 [DE] Fed. Rep. of Germany ..... 2718607

[51] Int. Cl.[2] ..... D05B 27/14

[52] U.S. Cl. ..... 112/318

[58] Field of Search ..... 112/210, 211, 214

[56] References Cited

U.S. PATENT DOCUMENTS

| | | | |
|---|---|---|---|
| 2,494,888 | 1/1950 | Le Vesconte et al. | 112/214 |
| 2,678,010 | 5/1954 | Pinkvoss | 112/214 |
| 2,730,977 | 1/1956 | Hayes et al. | 112/210 X |
| 3,853,078 | 12/1974 | Marforio | 112/211 |
| 4,073,248 | 2/1978 | Marforio | 112/214 X |

*Primary Examiner*—Wm. Carter Reynolds
*Attorney, Agent, or Firm*—McGlew and Tuttle

[57] ABSTRACT

A sewing machine for sewing and feeding material has a rotatable main shaft in a housing which is connected to drive a reciprocating needle for reciprocation in a stitching area. Adjacent the needle is a presser rod which depends from the housing and a carrier is mounted on the rod for upward and downward movement and is biassed downwardly so as to press a feed roller rotatably mounted on the carrier against the material to be fed. A drive mechanism for the feed roller is mounted on a bracket extending outwardly from the housing, and it includes a rotatable drive gear which is driven intermittently through an oscillation mechanism driven from the main shaft. A substantially triangular rocker member is pivotally mounted on the same axis as the drive wheel, and it supports two spaced apart guide rollers over which a drive belt is guided. The drive belt is connected to the gear drive wheel and to a gearwheel on the feed roller to rotate the feed roller intermittently. The construction includes a coupling rod connected between the carrier and the rocker which is adjustable in length. The gear belt, which is guided around the uppermost one of the guide rollers defines an engagement angle around the roller which has a bisector which intersects the longitudinal axis of the coupling rod in a substantially horizontal plane. The driving arrangement is such that the lifting force produced by the belt pull during the drive of the feed roller is substantially eliminated.

6 Claims, 2 Drawing Figures

SEWING MACHINE HAVING A DRIVEN FEED ROLLER

BACKGROUND OF THE INVENTION

1. Field of the Invention

The invention relates in general to sewing machines and in particular to a new and useful sewing machine with a feed roller, a spring-loaded carrier carrying the feed roller and moving substantially in vertical directions, a driving wheel; arranged, with respect to the sewing direction, behind the feed roller, and which is in operating connection with a drive shaft, and a belt running over guide rollers which forms the driving connection between the feed roller and the driving wheel.

2. Description of the Prior Art

The known sewing machines have a disadvantage that the vertical component of the driving force acting on the pulling strand of the drive belt has a disadvantageous effect on the pressure of the feed roller on the sewing material while pressure is necessary for a satisfactory feed of the sewing material. This has a particularly unfavorable effect when a pulling force is required for feeding the sewing material, for example, when sewing over transitions or when using cloth guiding apparatus which offer a different resistance to the sewing material at different thicknesses. The variable belt force necessary for carrying out these operations influences the pressure of the feed roller on the sewing material, particularly when it is necessary to maintain the normal pressure for a satisfactory feed of the sewing material. When the pressure of the feed roller varies with changing driving requirements, the uniformity of the feeding action of this roller is impaired, and thus also the sewing result.

The invention provides a belt drive where the pressure of the feed roller remains constant with changing driving forces. In accordance with the invention, the guide roller for the pulling strand of the belt is rotatably secured on a rocker pivotally mounted coaxially to the driving wheel.

The part of the strand extending between the guide roller and the driving wheel is substantially horizontal, and the rocker is connected with a carrier for the feed roller over a coupling rod whose longitudinal axis intersects the bisector of the looping angle of the belt about the guide roller substantially in the horizontal plane through the axis of rotation of the rocker.

Accordingly, it is an object of the invention to provide a sewing machine for sewing and feeding material which has a housing with a main shaft rotatable in the housing for driving the needle, and with a feed roller carrier which is mounted on a pressure rod which depends from the housing for movement upwardly and downwardly, which carries a feed roller which is rotatable thereon which engages the material to be fed, and wherein a feed roller carries a driven gear which is driven from a drive gear through a drive belt, and wherein the drive gear is intermittently driven from the main shaft, further including a connecting rod connected between the carrier and a rocker which is pivoted on the same axis as the drive gear, and which carries two guide rollers over which the drive belt is driven, and wherein the connection between the connecting rod and the rocker is such that the belt forms an engagement angle about one of the guide rollers which has a bisector which intersects the longitudinal axis of the connecting rod substantially in the horizontal plane extending through the axis of rotation of the rocker.

A further object of the invention is to provide a sewing machine which has a drive roller which is mounted to engage the material being threaded which is connected to a drive mechanism such that there is substantially no lifting force produced by the pull of the drive belt which drives the drive roller during the feeding of the material.

A further object of the invention is to provide a sewing machine which is simple in design, rugged in construction, and economical to manufacture.

The various features of novelty which characterize the invention are pointed out with particularly in the claims annexed to and forming a part of this disclosure. For a better understanding of the invention, its operating advantages and specific objects attained by its uses. Reference is made to the accompanying drawings and descriptive matter in which preferred embodiments of the invention are illustrated.

GENERAL DESCRIPTION OF THE PREFERRED EMBODIMENTS

Figure 1:
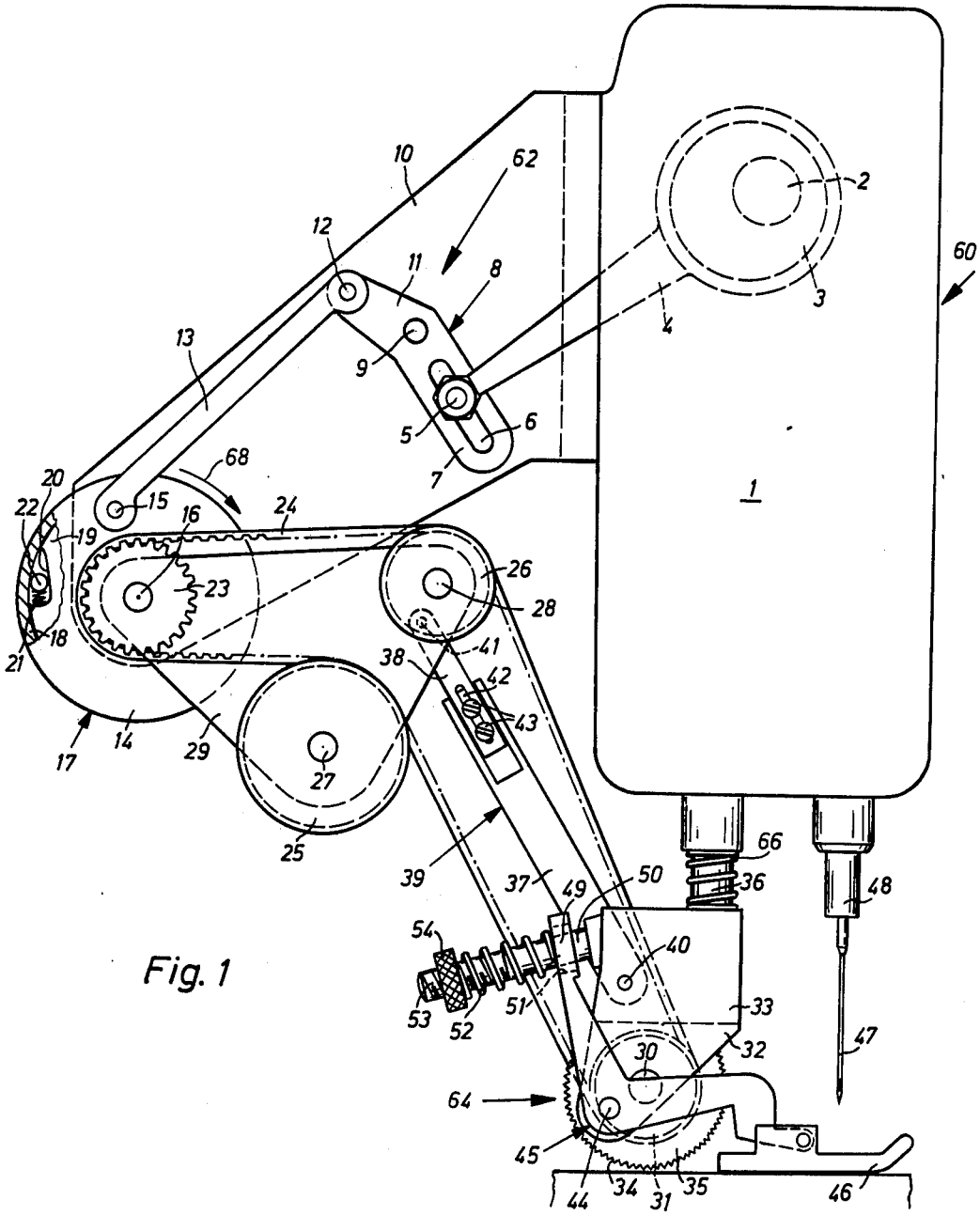
FIG. 1 is a partial side elevational and sectional view of a feed roller drive mechanism for a sewing machine constructed in accordance with the invention.

Referring to the drawings in particular, the invention embodied therein comprises a sewing machine generally designated 60 which includes a housing 1, a main shaft 2 rotatably mounted therein for reciprocating a needle 47 and for driving a feed mechanism generally designated 62 for intermittently rotating a drive gear or wheel 23 which is rotatable on a shaft 16 journaled on a bracket or supporting arm 10. The drive gear 23 drives a material feeding mechanism generally designated 64, which includes a carrier 33 which is mounted on a pressure rod 36 which depends from the housing 1 which may move upwardly and downwardly, which is biassed downwardly by a spring 66. The carrier 33 has two fork arms 32 which are spaced apart and provide a support for rotatably mounting a shaft 30 carrying a feed roller 35 and a gear wheel 31. The feed roller gear wheel 31 is driven from the drive wheel 23 by means of an endless gear belt or tooth belt 24, which is trained around the drive wheel 23 and the feed roller gear wheel 31, and is also guided over a guide roller 25 and a guide roller 26 having journals 27 and 28 which are rotatably mounted on a rocker member or plate 29. Plate 29 is substantially triangular so that the guide rollers 25 and 26 and the gear wheel 23 are arranged at spaced location from each other.

In accordance with the invention, the rocker 29 is positioned with respect to the carrier 33 by a coupling rod or connecting rod 39 which is adjustable in length and which is arranged so that the forces acting upon the drive mechanism and upon the material are optimally acting.

On a main shaft 2 mounted in housing 1 of a sewing machine is secured an eccentric 3 which is embraced by an eccentric rod 4. The latter carries a hinge pin 5 which is secured adjustably in a slot 6 of a lever arm 7. Lever arm 7 is a part of a lever 8 which is connected to an axle 9 mounted in a supporting arm 10 secured on housing 1. Lever 8 has a second arm 11 which is connected by means of a hinge pin 12 to one end of a governor 13 whose other end embraces a pin 15 secured on a clutch housing 14.

Clutch housing 14, which rests loosely on a clutch shaft 16 mounted in supporting arm 10, is part of a freewheel clutch 17, and has a circumferential wall 18 inside of which is mounted an entrainer disc 19 rigidly connected with shaft 16. Entrainer disc 19 has on its outer circumference eccentric recesses 20 in each of which is provided a roller 22 loaded by a spring 21. Due to the eccentric form of the recesses 20, the space provided for the respective rollers 22 is narrowed unilaterally in wedgeform.

On shaft 16 is secured a driving wheel or gear 23 about which is looped a toothed belt 24 which runs over two guide rollers 25 and 26. Guide rollers 25 and 26 are mounted on journals 27 and 28 which are secured on a rocker 29 which is loosely mounted on shaft 16. The toothed belt 24 also surrounds a gear wheel 31 secured on shaft 30. Shaft 30, which is mounted between a pair of forked arms 32, 32 of a carrier 33, is rigidly connected with a feed roller 35 having on its circumference teeth 34. Carrier 33 is mounted on a spring-loaded cloth presser rod 36 for movement in a vertical plane in housing 1. Spring means 66 biases the carrier 33 downwardly.

Figure 2:
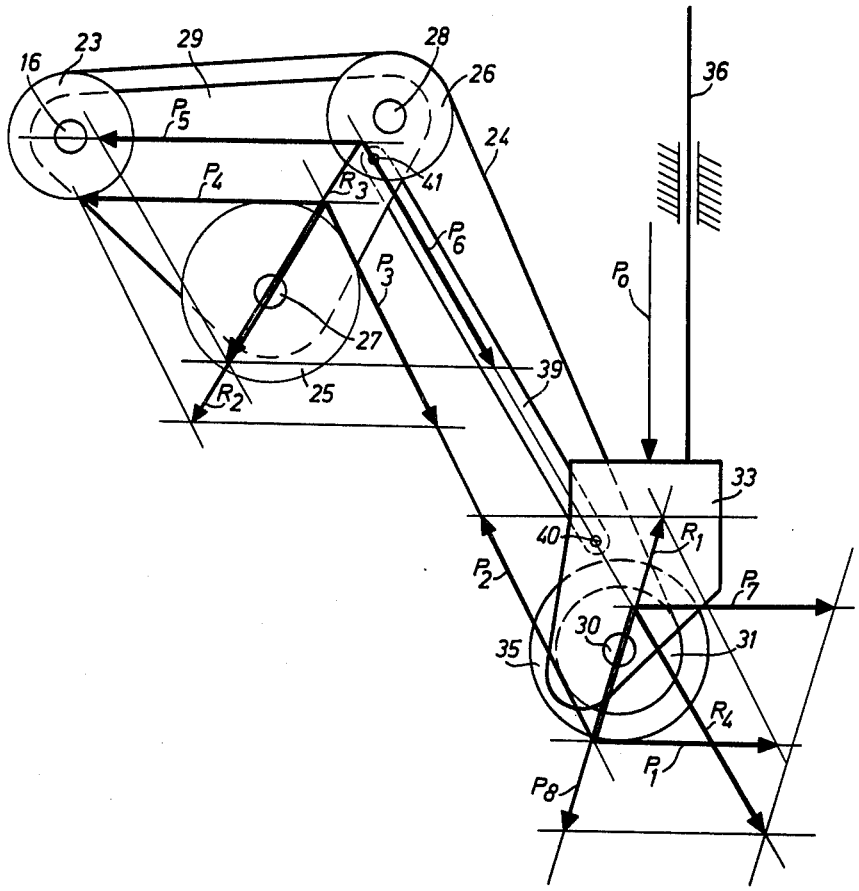
FIG. 2 is a schematic representation of the drive mechanism of FIG. 1 indicating the forces acting on the various parts.

A coupling rod 39 consisting of two rod parts 37 and 38 is articulated by means of a journal 40 on the carrier 33, and by means of a journal 41 on the rocker 29. An elongated hole 42 provided in rod part 38, through which are passed screws 43 connecting the two rod parts 37 and 38, permits adjustment of the effective length of coupling rod 39 to ensure a tight guidance of toothed belt 24. The journal 27 of the guide roller 25 is so secured on rocker 29 that the part of toothed belt 24 extending between guide roller 25 and driving wheel 23 is substantially horizontal, when feed roller 35 is in its normal operating position on the sewing material. In addition, journal 41 provided for the articulation of coupling rod 39 is so secured on rocker 29 that, likewise in the normal operating position of feed roller 35, the intersection of the line passing through the journals 40 and 41 with the bisector of the looping angle of toothed belt 24 about guide roller 25 is in the horizontal plane through the axis of rotation of rocker 29, as shown in FIG. 2.

On a journal 44 secured in one formed arm 32 of the carrier 33 is mounted a double arm lever 45. Double arm lever 45 has a first arm portion, which carries, at one end, a cloth presser foot sole 46, which is articulated thereon. The presser foot 46 extends into the range of the stitch-forming point of the sewing machine, through which runs the path of a needle 47. The needle 47 is secured in a needle bar 48 moving vertically in housing 1.

Stop means are in the form of a stop 49 which is carried on a second arm portion of the double arm lever 45 and a counterstop 49' carried on the rod 50. The stop 49 has a recess 51 for embracing a rod 50 secured on the carrier 33 and can engage against the counterstop 49'. A spring 52 on rod 50 pushes against the stop 49 and it bears on a nut 54 threaded onto the threaded end 53 of rod 50. By adjusting nut 54, it is possible to adjust the pressure of sole 46 on the sewing material.

During the operation of the sewing machine, main shaft 2 sets lever 8 in oscillation through the action of the eccentric 3 and the eccentric rod 4, so that the lever swings clutch housing 14 back and forth about shaft 16 via governor 13. Roller 22 jams between the eccentric recesses 20 and the interior of circumferential wall 18 during the movement of clutch housing 14 in the direction of the arrow 68 and takes along entrainer disc 19 in this direction, while the locking of the rollers 22 during the movement of clutch housing 14 opposite to the direction of the arrow is unlocked and entrainer disc 19 remains motionless. Entrainer disc 19 thus drives feed roller 35 intermittently through the looped belt 24.

By adjusting hinge pin 5 in slot 6 of lever 8, the size of the feed of feed roller 35 can be varied and adjusted respectively to a known underfeed, if any. The fastening of eccentric 3 on main shaft 2 is effected in known manner in such a way that feed roller 35 is driven during the piercing phase of operating the needle 47.

In FIG. 2 the forces appearing during the drive of feed roller 35 by belt 24 are represented as vectors. The force acting on cloth presser rod 36 by the adjustable pressure of a spring (not shown) on cloth presser rod 36 is designated with $P_0$ and the circumferential force for feeding the sewing material acting on feed roller 35 with $P_1$. This circumferential force $P_1$ requires in the pulling strand of toothed belt 24 a belt pulling force $P_2$ whose magnitude is determined by the effective radii of feed roller 35 and of gear wheel 31 rigidly connected with it. From these two forces $P_1$ and $P_2$ results a force $R_1$ which extends through the axis of rotation of feed roller 35 and lifts feed roller 35 from the sewing material during the drive of the latter.

The belt pulling force $P_2$ acting on the circumference of gear wheel 31 acts in the same magnitude on toothed belt 24 on the circumference of guide roller 25 as a belt pulling force $P_3$ and as a belt pulling force $P_4$. These two forces $P_3$ and $P_4$ cause a resultant force $R_2$ extending through the journal 27. Since their line of action extends, due to the selected design through the intersection of the line of action of coupling rod 39 with the horizontal plane through the axis of rotation of rocker 29, this force $R_2$ can be represented as acting in the above mentioned intersection, so that it is designated with $R_3$. This force $R_3$ provides the bearing pressure $P_5$ of rocker 29 on shaft 16 and on the respective bearing, and force component $P_6$ on coupling rod 39. Force component $P_6$ displaced in its line of action and arranged in the intersection with force $R_1$ can be decomposed into the horizontal force $P_7$ and into force $P_8$ acting in the direction of force $R_1$. It can be seen that the forces $R_1$ and $P_8$ are equal, but oppositely directed, so that they cancel each other out.

In the suggested solution, the lifting force produced by the belt pull during the drive of feed roller 35 by toothed belt 24 and acting on feed roller 35 is thus completely eliminated, and an optimum effect is achieved.

The arrangement of feed roller 35 is not limited to the position behind the path of needle 47 represented in the embodiment, but feed roller 35 can be arranged just as well next to or ahead of the path of needle 47, while maintaining the above described advantages.

While specific embodiments of the invention have been shown and described in detail to illustrate the application of the principles of the invention, it will be understood that the invention may be embodied otherwise without departing from such principles.

What is claimed is:

1. A sewing machine comprising a housing, means mounting a carrier on said housing for upward and downward movement, means biasing said carrier downwardly, a feed roller rotatably supported on said carrier having a periphery adapted to engage the material to be fed, a driving gear wheel rotatably mounted on said housing, a drive shaft connected to said driving gear wheel for rotation therewith, a driven gear wheel connected to said feed roller for rotation therewith, a gear belt engaged over said driving gear wheel and said driven gear wheel for driving said driven gear wheel and said feed roller from said driving gear wheel, a rocker member mounted for pivotal movement on the same axis as that about which said driving gear wheel rotates, first and second spaced apart guide rollers rotatably mounted on said rocker member at spaced locations from said driving gear wheel, said gear belt being guided over said first and second guide rollers and defining an engagement angle over said first guide roller, said belt having a portion extending between said first guide roller and said driving gear wheel which is substantially horizontal, and a connecting coupling rod connecting said rocker and said carrier, and having a longitudinal axis intersecting the bisector of the engagement angle of the belt over said first guide roller substantially in a horizontal plane extending through the axis of rotation of said rocker.

2. In a sewing machine for sewing and feeding material which includes a housing, a main shaft rotatable in the housing, a presser rod mounted on said housing, a reciprocating needle mounted in said housing adjacent said presser rod connected to the main shaft for rotation thereby; the improvement comprising a carrier mounted on said presser rod for upward and downward movement, a feed roller mounted on said carrier and having a periphery engageable with the material to be sewn, and having a feed roller shaft, means for biasing said carrier with said presser rod downwardly into engagement with the material to be sewn, a drive gear having a gear shaft rotatably mounted on the housing, drive means connected to said main shaft and to said drive gear to periodically rotate said drive gear, a rocker member pivotally mounted on said gear shaft, first and second guide rollers rotatably mounted on said rocker member in spaced relationship to each other and to said drive gear, a driven gear affixed to said feed roller for rotation therewith, a gear belt engaged around said drive gear and said driven gear to drive said driven gear and said feed roller, and engaged over said first and second guide rollers, and a coupling rod interconnected with said rocker member and said drive gear and said first and second guide rollers so that said gear belt defines an engagement angle over said first guide roller in a manner such that the longitudinal axis of the coupling rod intersects the bisector of the engagement angle substantially in a horizontal plane extending through the pivot axis of said rocker.

3. The improvement claimed in claim 2, wherein said drive means comprises an eccentric engaged around said main shaft, a lever arm pivotally mounted on said housing adjacent said main shaft and connected to said eccentric for oscillation by said eccentric, a clutch having a clutch housing mounted for rotation about the axis of rotation of said drive gear, and connected to said lever arm for movement by said lever arm, and also being connected to said drive gear to rotate said drive gear.

4. The improvement claimed in claim 2, wherein said coupling rod includes first and second extensible parts and means for connecting said parts and locking them together in an adjusted position.

5. The improvement claimed in claim 2, including a presser foot double arm lever pivotally mounted on said carrier, and having a first arm portion and a second arm portion, a presser foot pivotally connected to said first arm portion and stop means arranged in the path of movement of said second arm portion limiting the pivoting movement thereof.

6. The improvement claimed in claim 5, including means biasing said second arm portion toward said stop means, said second arm portion being movable against said biasing means upon upward movement of said presser foot over the material to be sewn.

* * * * *